United States Patent [19]

Wallace et al.

[11] Patent Number: 4,884,411

[45] Date of Patent: Dec. 5, 1989

[54] HIGH HUMIDITY REFRIGERATION APPARATUS

[75] Inventors: Graeme B. Wallace, Bayswater; Glenn R. Adams, Seaford, both of Australia

[73] Assignee: Co-Ordinated Thermal Systems Pty. Ltd., Victoria, Australia

[21] Appl. No.: 193,378

[22] Filed: May 12, 1988

[51] Int. Cl.[4] ..... F25D 17/06

[52] U.S. Cl. ..... 62/91; 62/418

[58] Field of Search ..... 62/91, 418

[56] References Cited

U.S. PATENT DOCUMENTS

| | | | |
|---|---|---|---|
| 2,303,867 | 12/1942 | Stebbins | 62/91 X |
| 3,521,459 | 7/1970 | Rath | 62/91 X |
| 3,585,811 | 6/1971 | Friedel | 62/91 X |
| 4,467,612 | 8/1984 | Weasel, Jr. | 62/91 X |

*Primary Examiner*—Lloyd L. King

*Attorney, Agent, or Firm*—Bright & Lorig

[57] ABSTRACT

A high humidity refrigeration apparatus and method are disclosed. The high humidity refrigeration apparatus has an air inlet at a top thereof and an air outlet in a front thereof. The arrangement is such that when the high humidity refrigeration apparatus is fitted at one end of a chamber, such as a shipping container, goods in stacks, such as on pallets, can be loaded into the chamber from the other end of the chamber. Because the air which exits the outlet is the coldest and of the highest humidity available from the apparatus it is then caused to contact those goods which have been first loaded into the chamber before it contacts any subsequently loaded goods. This ensures that the first loaded goods are always kept as cold and in as high a humidity environment as possible.

6 Claims, 4 Drawing Sheets

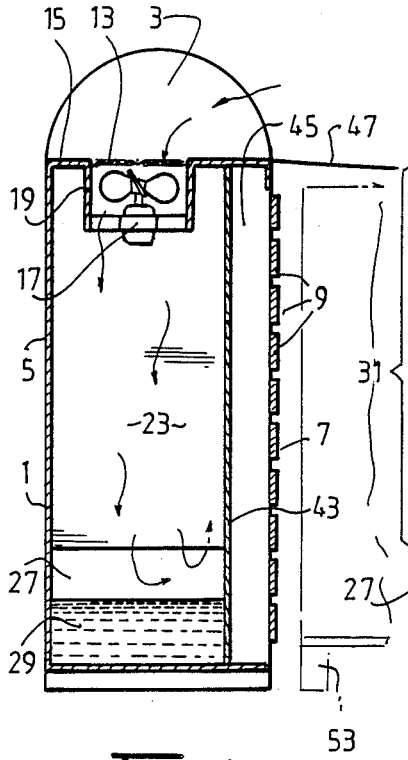
FIG. 7.
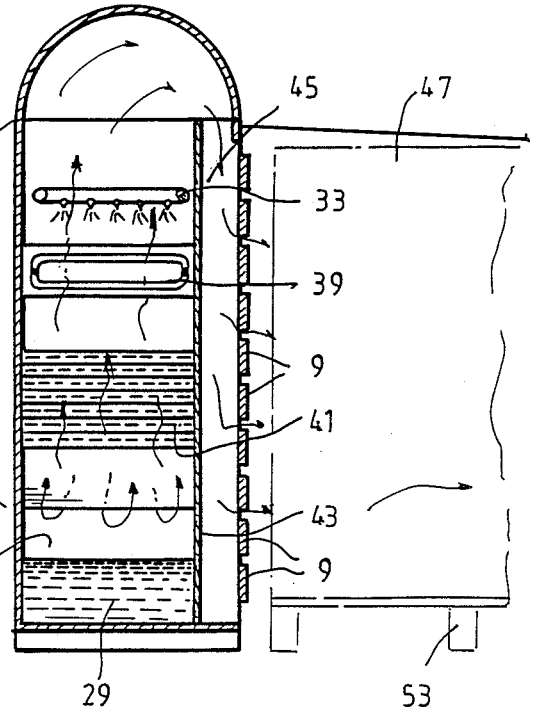
FIG. 8.
FIG. 9.
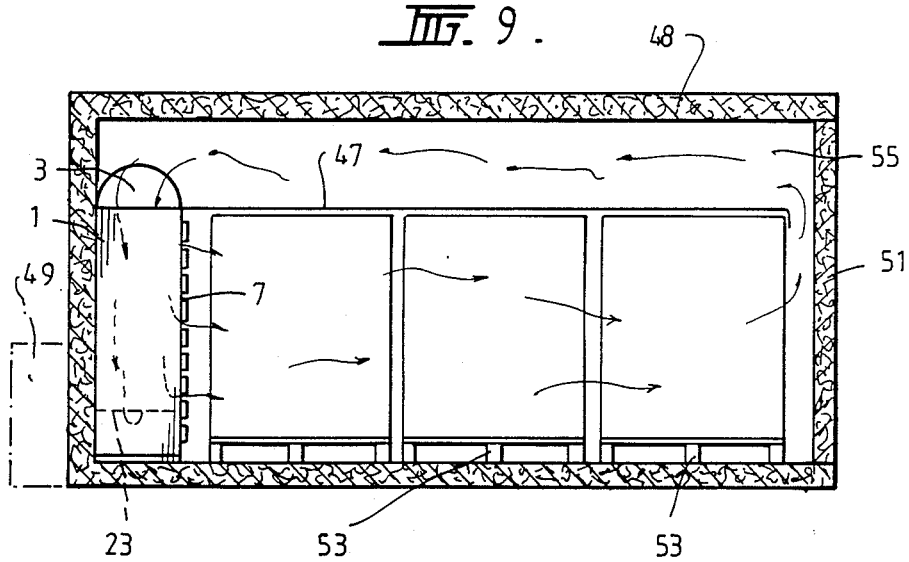

HIGH HUMIDITY REFRIGERATION APPARATUS

FIELD OF THE INVENTION

This invention relates to a high humidity refrigeration apparatus and relates particularly but not exclusively to such for use in refrigeration apparatus where it is required to maintain vegetables in a high humidity environment to inhibit dehydration.

BACKGROUND OF THE INVENTION

It is known to provide high humidity refrigeration apparatus for maintaining a high humidity environment in a store in which vegetables such as lettuce, celery, cabbage, cauliflower can be kept immediately following harvesting. Such high humidity refrigeration apparatus is used so that field heat can be quickly removed from the harvested vegetables to inhibit dehydration.

In recent times it has been proposed to provide a shipping container with a high humidity refrigeration apparatus so that pallets, for example, containing the harvested vegetables, can be loaded into the shipping container in a field, and then subsequently removed in that shipping container to a distribution point.

The known high humidity refrigeration apparatus of this type comprises a heat exchanger which will provide high humidity to air that is fan forced through the goods. Typically, the heat exchanger comprises an open mesh structure on which cooled water collects. The open mesh structure provides a plurality of leading edges to the air, and as a consequence the air takes up moisture from the leading edges to increase the humidity of the air. The air, in turn, is passed into a chamber in which the vegetables are stored. Typically the water is first sprayed onto a cooling heat exchanger so that the water is cooled to a suitable temperature. The cooling heat exchanger is, in turn, cooled by conventional refrigeration apparatus. The humidity provided by such high humidity refrigeration apparatus is usually in the range 97 to 90% relative humidity. Typically the air flow required is in the range of 3000 $ft^3$ to 36000 $ft^3$ per minute.

In the known high humidity refrigeration apparatus, air which passes through the refrigeration apparatus is caused to enter the refrigeration apparatus either in a front wall thereof or at a lowermost region thereof. The air which is discharged is discharged from the top of the casing. Typically, the high humidity refrigeration apparatus is placed at one end of a chamber, and vegetables are loaded onto pallets which are successively stacked side by side in the chamber. A blind or curtain extends over the tops of the vegetables on the pallets to ensure that the discharged air from the high humidity refrigeration apparatus passes over the tops of all of the vegetables in the pallets and is then caused to flow successively through the side by side pallets from the end of the chamber remote from that where the high humidity refrigeration apparatus is located. In other words, the air passes and contacts the vegetables stacked on the pallets from the end of the side by side arranged pallets at an end of the chamber which can be opened to permit loading and/or unloading of the pallets.

We have realized there is a serious disadvantage in this prior art structure and method because the vegetables on the first loaded pallet are closest to the air inlet for the high humidity refrigeration apparatus. That, in turn, means that the air which passes through those vegetables is not the coldest or the highest humidity air which can be provided. Accordingly, the vegetables on the pallet which is first loaded may, in fact, be in an environment where there is insufficient cooling and humidity available to satisfactorily remove all of the field heat therefrom and as a consequence such vegetables may dehydrate.

OBJECTS AND STATEMENT OF THE INVENTION

Accordingly, it is an object of the present invention to provide improved high humidity refrigeration apparatus and an improved method for use in high humidity refrigeration apparatus where vegetables on pallets which are first loaded into the apparatus are always subject to the air which is discharged from the high humidity refrigeration apparatus first, i.e. so that such vegetables will have the highest humidity and lowest temperature air applied thereto at all times regardless of any subsequent loading of vegetables on further pallets into the chamber of the high humidity refrigeration apparatus.

STATEMENT OF THE INVENTION

According to one aspect of the present invention there is provided a high humidity refrigeration apparatus comprising a casing, an air inlet and an air outlet in said casing, air humidifying and cooling means within said casing, fan means for causing air to flow through said casing by passing into said inlet, past said air humidifying and cooling means where it will at least be humidified, and out from said outlet, the air inlet being in an upper region of said casing and said air outlet being in a frontal region of said casing so that, in use, goods to be subjected to at least humidified air therefrom can be placed in front of said high humidity refrigeration apparatus and air can flow through said goods by passing directly from said outlet and then be returned to said inlet.

According to a further aspect of the present invention there is provided a method of removing heat from goods, such as vegetables, and for maintaining said goods cooled and in humidified air comprising:

(a) providing a chamber in which said goods can be received;
(b) providing goods in said chamber;
(c) cooling and humidifying air with a high humidity refrigeration apparatus;
(d) passing the cooled and humidified air through said goods directly from an outlet of said high humidity refrigeration apparatus;
(e) causing the air which has passed through said goods to be returned to an inlet of said high humidity refrigeration apparatus.

BRIEF DESCRIPTION OF THE DRAWINGS

In order that the invention can be more clearly ascertained, an example of a preferred embodiment will now be described with reference to the accompanying drawings, wherein:

FIG. 7 is a side cross-sectional view taken in the direction of section 7—7 shown in FIG. 3;

FIG. 8 is a side cross-sectional view taken in the direction of section 8—8 shown in FIG. 3; and FIG. 9 is a side vertical cross-section of the high humidity refrigeration apparatus within a chamber within which vegetables can be loaded on pallets arranged side by side.

DETAILED DESCRIPTION OF PREFERRED EMBODIMENT

Figure 1:
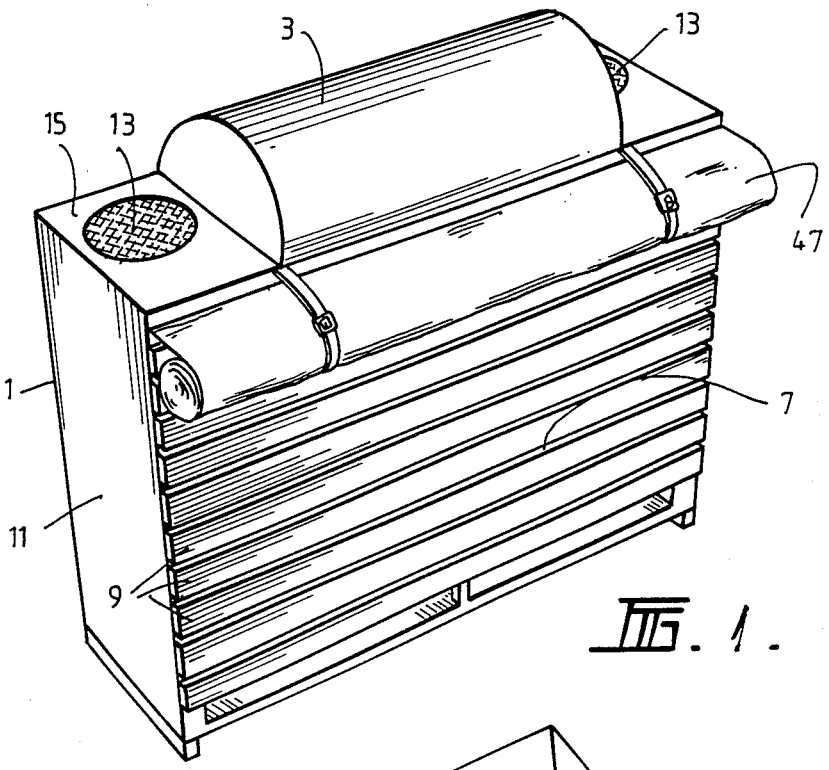
FIG. 1 is a front top perspective view of a preferred embodiment of a high humidity refrigeration apparatus.
Figure 2:
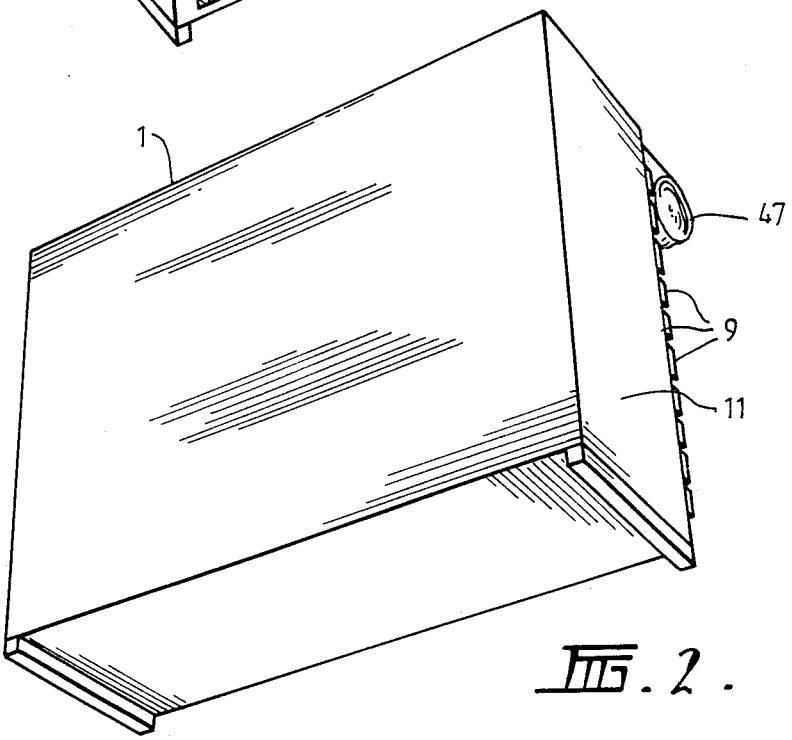
FIG. 2 is an underneath rear perspective view of the apparatus shown in FIG. 1.
Figure 5:
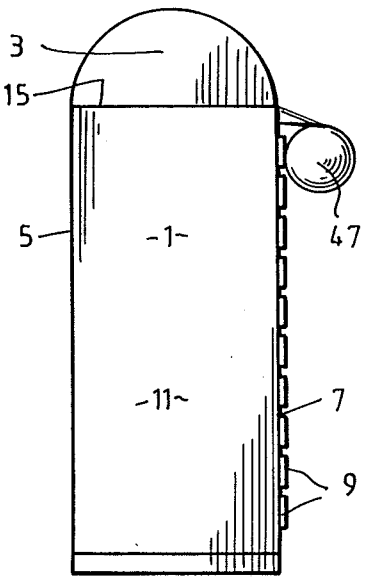
FIG. 5 is a side view of the apparatus shown in FIG. 3.
Figure 3:
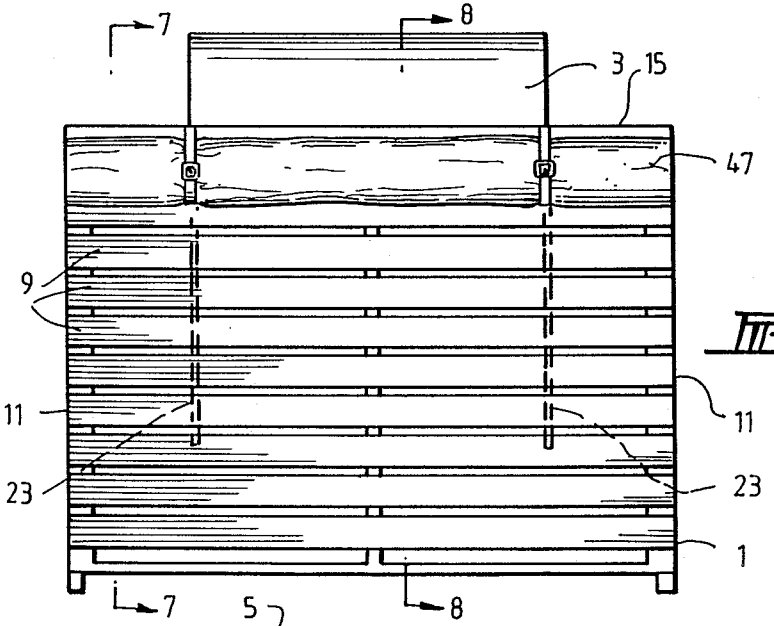
FIG. 3 is a front view of the apparatus shown in FIGS. 1 and 2.
Figure 4:
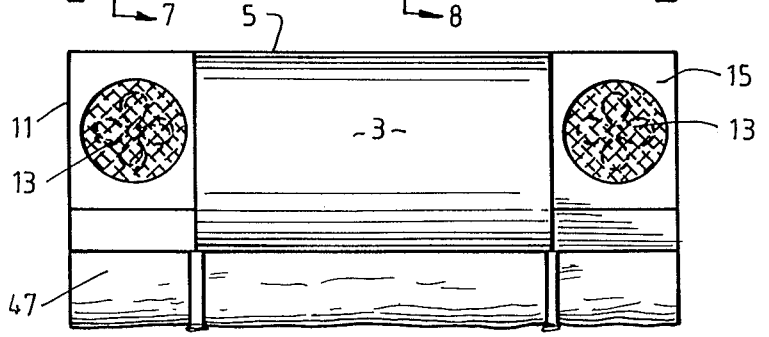
FIG. 4 is a plan view of the apparatus shown in FIG. 3.
Figure 6:
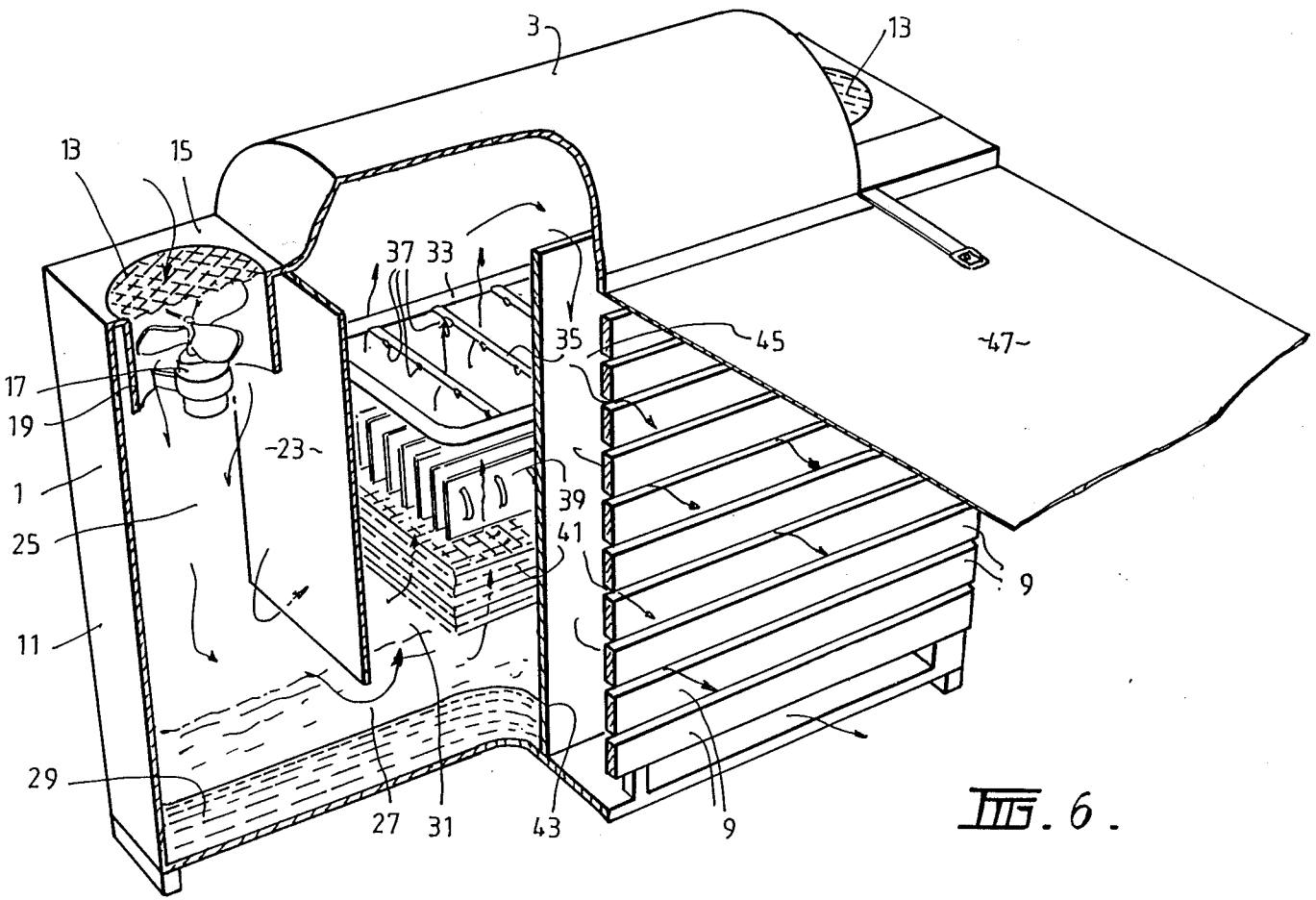
FIG. 6 is a front perspective partial cross-section view of the apparatus shown in FIGS. 1 through 5.

Referring generally to FIGS. 1 through 8 it can be seen that the high humidity refrigeration apparatus has an outer casing 1 which is typically of sheet steel which is suitably surface protected to inhibit rusting. The casing is generally rectangular with an upper arcuate shaped air transfer portion 3. The casing 1 has a rear face 5 and a front face 7. The front face 7 is open but is covered with a plurality of slats 9 which are horizontally extending. The air transfer portion 3 is located centrally between side faces 11 and air inlet openings 13 are provided in the top surface 15 on each side of the air transfer portion 3.

Two fan means 17 are mounted within the casing 1 and axially in line with the respective air inlet openings 13. Each of the axial fan means 17 is provided with cylindrical walls 19 which improve air flow through the axial fan means 17. A grill 21 is provided over each of the air inlet openings 13 to inhibit foreign objects contacting with the axial fan means 17. Directly underneath the air transfer portion 3, within the casing 1, is provided two opposed wall means 23 which provide a pair of inlet chambers 25 — one for each of the axial fan means 17 (this is clearly shown in FIG. 6). The wall means 23 extends from the top 15 of the casing 1 downwardly towards the bottom of the casing 1 but stop short of the bottom to provide respective air transfer spaces 27 (best shown in FIGS. 7 and 8) above a water reservoir 29 at the bottom of the casing 1.

A heat exchanger chamber 31 is provided within the casing 1 directly under the air transfer portion 3.

Mounted within the heat exchanger chamber 31 is an uppermost manifold 33 which has a plurality of arms 35 on which are arranged a plurality of water spray nozzles 37.

Directly under the manifold 33 is provided a cooling heat exchanger 39. The cooling heat exchanger 39 is of known construction and comprises a plurality of pipes with heat exchange fins thereon. The pipes contain refrigerant mediums so that the cooling heat exchanger 39 will cool water which is sprayed thereonto from the water spray nozzles 37.

Mounted below the cooling heat exchanger 39 is a heat exchanger module 41 of a type, for example, disclosed in Australian Patent Specifications Nos. 569,232 and 563,636 in the name of Co-Ordinated Thermal Systems Pty. Limited, the assignee of the present application. It is desirable to use heat exchangers of the type disclosed in those Australian patent specifications although it is not essential. Any known heat exchanger for air handling apparatus can be utilized but the heat exchanger disclosed in the aforementioned Australian patent specifications provides for substantially unrestricted air flow therethrough and yields high humidity to the air.

An internal front wall 43 is provided within the casing 1 to provide an outlet chamber 45 for air which passes through the high humidity refrigeration apparatus.

A submersible pump (not shown) is placed within the water reservoir 29 and passes water to the manifold 33 where it can be sprayed from the water spray nozzles 37. The water then falls by gravity onto the cooling heat exchanger 39 where it is cooled and it then falls onto the heat exchanger module 41 where it clings to the surfaces thereof to provide water on leading edges of the heat exchanger module 41. As the air passes through the heat exchanger chamber 31 — through the heat exchanger module 41, it is increased in humidity — and is cooled. Any excess water simply falls to the water reservoir 29.

It can be seen from FIGS. 1 through 8 that the air enters the high humidity refrigeration apparatus by passing through the air inlet openings 13 and then progresses downwardly through the inlet chambers 25, past the air transfer space 27 and into the heat exchanger chamber 31 and then into the air transfer portion 3 and finally into the outlet chamber 45 where it can be dispersed between the slats 9. Thus, the air is increased in humidity and cooled as it passes through the high humidity refrigeration apparatus.

A roll blind 47 is provided at the top of the front of the high humidity refrigeration apparatus so that as stacks of goods such as fresh vegetables are placed adjacent the high humidity refrigeration apparatus, air can be caused to pass through a stack of such goods rather than passing upwardly through the stack which would be occasioned if the blind 47 was not provided.

Referring now to FIG. 9 it can be seen how the high humidity refrigeration apparatus can be fitted within a chamber such as a shipping container 48. Typically, the shipping container 48 can be thermally insulated. The high humidity refrigeration apparatus is fitted at one end of the container 48 as shown. The necessary compressor for providing cooling to the cooling heat exchanger 39 is mounted externally of the shipping container 48 as shown by numeral 49. Small openings in the shipping container 48 can be provided to enable the refrigerant medium to pass between the compressor 49 and the cooling heat exchanger 39.

At the end of the shipping container 48 remote from the high humidity refrigeration apparatus there may be provided doors 51 by which access may be obtained into the shipping container 48. As shown, goods such as vegetables can be stacked on pallets 53 which can be placed side by side within the shipping container 48. Typically the width of the high humidity refrigeration apparatus is substantially equal to the internal width of the shipping container 48 so that it can neatly fit therein. Similarly, the width of the pallets 53 or goods on the pallets 53 is substantially equal to the internal width of the shipping container 48 so they can neatly be fitted therein. The blind 47 is unrolled and placed over the tops of the stacks of goods in the respective pallets 53 as shown. Thus, the air which leaves the high humidity refrigeration apparatus first directly passes from the outlet through the stack on the first loaded pallet 53 and successively through the second and third etc.. The blind 47 ensures that the air passes successively serially through the stacks of each of the pallets. An air space 55 is provided above the blind 47 or on top of the goods to provide a passageway for air to be returned to the high humidity refrigeration apparatus. Thus, it can be seen that goods which are first loaded into the shipping container 48 are always subjected to the coldest and highest humidity i. This is contrasted significantly with the known high humidity refrigeration apparatus used in chambers where the air exits from the top of the high humidity refrigeration apparatus and passes through the air space 55 in the opposite direction to that shown. Hence, as goods on pallets 53 are successively loaded into the chamber, the heat from the goods is transferred to the air and accordingly the first loaded goods on pallets 53 receives the warmest and least humidified air. In some instances the prior art constructions and methods have been such that the goods which are first loaded can dehydrate. With the apparatus and method disclosed herein the arrangement is such that the first loaded goods are always subjected to the coldest and highest humidity air.

It should be realized that the above description is of one particular preferred embodiment only and that other embodiments are possible.

Modifications may be made to the present invention as would be determined by persons skilled in the refrigeration arts and/or transporting arts and such are deemed to be within the scope of the appended claims.

We claim:

1. A high humidity refrigeration apparatus comprising a heat exchanger casing containing air humidifying and cooling means, said air humidifying and cooling means comprising uppermost water spray nozzle means, a cooling heat exchanger mounted underneath said water spray nozzle means for cooling water sprayed from said nozzle means, and a heat exchanger mounted underneath said cooling heat exchanger for humidifying air with water which has been cooled by said cooling heat exchanger, an air inlet at the top of said heat exchanger casing for directing air to be humidified and cooled to the bottom of said heat exchanger casing where it can pass upwardly therethrough past said air humidifying and cooling means and into an outlet chamber connected with said heat exchanger chamber, said outlet chamber having a forward upright face with air outlet means therein through which air passing through said high humidity refrigeration apparatus can exit.

2. A refrigeration apparatus as claimed in claim 1, fitted with a chamber in which goods to be subjected to humidified and cooled air can be placed, said refrigeration apparatus being at one end of said chamber, said air outlet means being at said one end of said chamber and so that air exiting therefrom will be directed towards the other end of said chamber and so that when goods are loaded into said chamber, said air exiting from said refrigeration apparatus will pass through said goods directly from said air outlet means and then return to said inlet, said inlet being at said one end of said chamber.

3. A refrigeration apparatus as claimed in claim 2, including means for placing over the top of goods in said chamber to assist air to flow through said goods before returning to said inlet, the return path of said air to said inlet being over the top of said goods above said means.

4. A method of removing heat from goods, such as vegetables, and for maintaining said goods cooled and in humidified air comprising:

(a) providing cooled and humidified air;

(b) loading goods to be maintained cooled and humidified in an elongate horizontally extending chamber in groups, a first group being at one end of said chamber, a second group being horizontally displaced from but next to the first group;

(c) passing the cooled and humidified air in step (a) through the first group and then through the second group; and (d) allowing the air which has passed through the second group to pass over the top of said goods to then be cooled and humidified and returned to step (c);

whereby heat can be removed from the goods and the goods can be maintained cooled and in humidified air.

5. A method as claimed in claim 4, wherein each group is substantially of the same width as the width of said chamber in a direction transverse to the elongate length of said chamber.

6. A high humidity refrigeration apparatus comprising a heat exchanger casing including air humidifying and cooling means, said air humidifying and cooling means comprising water-spraying means near the top of said casing, cooling heat exchanger means mounted beneath said water-spraying means for cooling water sprayed therefrom, and heat exchanger means mounted beneath said cooling heat exchanger means for humidifying air with water which has been cooled by said heat exchanger means, an air inlet for directing air to be humidified and cooled to the bottom of said heat exchanger casing where it can pass upwardly therethrough past said air humidifying and cooling means into a forward-facing air outlet means; chamber means for receiving said high humidity refrigeration apparatus near one end thereof, with said air outlet means being at said one end of said chamber so that air therefrom can be directed toward the other end of said chamber and so that when goods are loaded into said chamber, air exiting from said air outlet means can pass through said goods from said air outlet means and then return to said air inlet, said air inlet being at said one end of said chamber, said chamber including cover means that can be placed over the top of goods in said chamber to assist air to flow through said goods before returning to said air inlet and to provide a return path of air to said air inlet over the top of said cover means.

* * * * *